United States Patent [19]

Marion et al.

[11] 3,945,202

[45] Mar. 23, 1976

[54] ROCKET CONTAINING LEAD OXIDIZER SALT-HIGH DENSITY PROPELLANT

[75] Inventors: Frank A. Marion; Hugh J. McSpadden, both of Riverside, Calif.

[73] Assignee: Universal Propulsion Co., Riverside, Calif.

[22] Filed: Nov. 5, 1973

[21] Appl. No.: 412,871

Related U.S. Application Data

[63] Continuation of Ser. No. 67,494, Aug. 27, 1970, abandoned.

[52] U.S. Cl. ..... 60/253; 60/39.47; 149/19.1; 149/19.3; 149/19.6; 149/19.9; 149/45; 149/83

[51] Int. Cl.[2] ..... C06D 5/06

[58] Field of Search ..... 149/19.1, 19.3, 19.6, 19.9, 149/19.92, 117, 37, 45, 83; 264/3 R, 3 B; 102/34, 37.1, 90; 60/253, 39.47

[56] References Cited

UNITED STATES PATENTS

| | | | |
|---|---|---|---|
| 2,970,898 | 2/1961 | Fox | 149/44 X |
| 3,046,168 | 7/1962 | Burkardt et al. | 149/42 |
| 3,152,027 | 10/1964 | Godsey | 149/19.92 |
| 3,257,801 | 6/1966 | Martinez et al. | 149/37 X |
| 3,418,184 | 12/1968 | Vetter | 149/19.9 |
| 3,601,053 | 8/1971 | Grall et al. | 102/90 X |
| 3,617,403 | 11/1971 | Johnson | 149/19.3 |
| 3,625,155 | 12/1971 | Douda et al. | 102/90 |
| 3,673,287 | 6/1972 | Thies et al. | 264/3 R |
| 3,677,840 | 7/1972 | Shaw et al. | 149/83 X |
| 3,765,177 | 10/1973 | Ritchey et al. | 264/3 R |

*Primary Examiner*—Benjamin R. Padgett
*Assistant Examiner*—E. A. Miller
*Attorney, Agent, or Firm*—Ellsworth R. Roston

[57] ABSTRACT

A propellant including a binder, a curative for the binder (whenever necessary), an oxidizer and a fuel additive are provided. The oxidizer has a relatively high value of specific gravity or density and is stable even at relatively high temperatures and is capable of supplying relatively high amounts of oxygen to the fuel additives or the reducing agents in the propulsion material. The propellant provides density-impulses greater than the density-impulses provided by the propellants of the prior art.

14 Claims, 7 Drawing Figures

INVENTORS:
Frank A. Marion
Hugh J. McSpadden
By Smyth, Roston & Pavitt
ATTORNEYS

Fig. 4a

| POLYBUTADIENE Binders | Examples I | II | III | IV |
|---|---|---|---|---|
| Butarez CTL, Type II Polybutadiene Bind'r | 7.330 | 6.435 | 6.435 | 5.898 |
| Triacetin | 2.198 | 2.214 | 2.214 | 2.030 |
| Dibutylphthalate | – | – | – | – |
| 1,2,4-Tris[2-(1-Aziridinyl)Ethyl]Trimellitate | 0.472 | 0.351 | 0.351 | 0.322 |
| Lead Nitrate(-354μ+124μ)(175μ avg.) | 54.50 | 40.000 | 40.000 | 58.850 |
| Lead Nitrate (-124μ) (30μ avg.) | 23.00 | 34.90 | 34.980 | 15.000 |
| Reynolds 1-131 Aluminum (10μ avg.) | 12.50 | 16.000 | 16.000 | 16.700 |
| Molybdenyl-bis-acetylacetonate | – | 0.100 | – | – |
| Titanium acetylacetonate | – | – | 0.020 | – |
| Hycat 6® | – | – | – | 1.000 |
| Specific Impulse, Isp, lbforce-sec/lb-mass | – | 180 | 183.7 | 144 |
| Density, lb/in³, ρ | 0.113 | 0.112 | 0.111 | 0.110 |
| Volumetric Impulse lbf sec/in³ | – | 20.0 | 20.4 | 15.9 |
| Burning Rate $r_b$, in/sec.(at 1000 psig) | 0.21 | .200 | .182 | .225 |
| Burning Rate exponent, n | 0.30 | .15 | .50 | .43 |
| Characteristic Exhaust Velocity, C*, ft/sec. | – | 3470 | 3550 | 3110 |
| Area Ratio, Kn, (at 1000 psig) | 365 | 425 | 415 | 450 |

| POLYSULFIDE Binders | V | VI | VII | |
|---|---|---|---|---|
| LP2 | 7.463 | – | – | |
| LP33 | | 7.600 | 7.600 | |
| Triacetin | 1.865 | 1.890 | 1.890 | |
| Lead Oxide | 0.448 | – | – | |
| Sulfur | – | 0.050 | 0.050 | |
| P-Quinone Dioxime | – | 0.460 | 0.460 | |
| Lead Nitrate (Unimodal Grind) (125μ avg.) | 77.500 | 77.500 | 175μ 63.00<br>40μ 12.00 | |
| Reynolds 1-131 Aluminum (10μ avg.) | 12.500 | 12.500 | 12.50 | |
| Iron Oxide C.K. WILLIAMS RY-2196 | – | – | 2.50 | |
| Aluminum Distearate | 0.224 | – | – | |
| Specific Impulse, Isp, lb/force-sec/lb mass | 162 | 163.5 | 162 | |
| Density, lb/in³, ρ | .125 | .120 | .120 | |
| Volumetric Impulse lbf-sec/in³ | 20.2 | 19.6 | 19.5 | |
| Burning Rate $r_b$, in/sec (at 1000 psig) | .307 | .285 | .285 | |
| Burning Rate exponent, n | .35 | .35 | .36 | |
| Characteristic Exhaust Velocity, C*, ft/sec | 3500 | 3250 | 3200 | |
| Area Ratio, Kn, (at 1000 psig) | 262 | 280 | 285 | |

Fig. 4b

INVENTORS:
Frank A. Marion
Hugh J. McSpadden
By Smyth, Roston & Pavitt
ATTORNEYS

Fig. 4C

| POLYBUTADIENE Binder MULTIPLE OXIDIZERS | VIII | IX | X | XI | XII | XIII |
|---|---|---|---|---|---|---|
| Butarez CTL Type II Polybutadiene Bind'r. | 5.898 | 6.569 | 6.570 | 6.570 | 8.940 | 7.037 |
| Triacetin | 2.030 | .986 | 2.270 | 2.270 | 3.070 | — |
| Dibutylphthalate | — | .985 | — | — | — | 1.759 |
| 1,2,4-Tris[2-(1-Aziridinyl)Ethyl]Trimellitate | 0.322 | .525 | 0.360 | 0.360 | 0.490 | .704 |
| Lead Nitrate ($^{-354\mu}_{+124\mu}$) (175 μ avg.) | 52.000 | — | — | 63.50 | — | 53.100 |
| Lead Nitrate (-124μ) (30 μ avg.) | — | 53.100 | — | — | 43.500 | 4.000 |
| Potassium Perchlorate (45-50 μ avg.) | 19.850 | 19.000 | — | — | — | 15.00 |
| Ammonium Perchlorate (175 μ avg.) | — | — | — | — | 30000 | — |
| Lead Dioxide | 2.000 | 2.000 | — | — | 1.000 | 2.000 |
| Hycat 6® | 1.000 | — | — | — | 1.000 | — |
| Reynolds 1-131 Aluminum (10 μ) | 16.900 | 16.900 | 8.800 | — | — | 16.400 |
| Potassium Iodate | — | — | 82.00 | — | — | — |
| Lead Iodate | — | — | — | 17.300 | — | — |
| Specific Impulse, Isp, lb/force-sec/lb mass | 166.8 | 183.0 | — | 158.7 | 165 | — |
| Density lb/in³, ρ | .101 | .102 | — | .116 | .087 | — |
| Volumetric Impulse lbf sec/in³ | 16.7 | 18.65 | — | 18.4 | 14.3 | — |
| Burning Rate $r_b$, in/sec (at 1000 psig) | 0.70 | 0.58 | 440 psig .87 in/sec | .23 | .375 | .49 |
| Burning Rate exponent, n | 0.63 | 0.70 | — | 0.47 | .53 | .70 |
| Characteristic Exhaust Velocity, C*, ft/sec. | 3600 | 3685 | — | 3550 | 3400 | — |
| Area Ratio, Kn, (at 1000 psig) | 153 | 170 | 480 @ 440 psig | 360 | .355 | 205 |

Fig. 4D

| POLYSULFIDE MULTIPLE OXIDIZERS | XIV |
|---|---|
| LP2 | 22.000 |
| Triacetin | 3.300 |
| Lead Dioxide | 1.540 |
| Pett-Consol SSS Antioxidant | 0.660 |
| Lead Nitrate ($^{-354\mu}_{+124\mu}$) (175 μ avg.) | 22.500 |
| Ammonium Perchlorate 175 μ avg. | 50.000 |
| Specific Impulse, Isp, lb/force-sec/lb mass | — |
| Density lb/in³ ρ | .070 lb/in³ |
| Volumetric Impulse lbf sec/in³ | — |
| Burning Rate $r_b$, in sec (at 1000 psig) | .635 |
| Burning Rate exponent, n | .5 |
| Characteristic Exhaust Velocity, C*, ft/sec | 3500 |
| Area Ratio, Kn. (at 1000 psig) | 345 |

INVENTORS:
Frank A. Marion
Hugh J. McSpadden
By Smyth, Roston & Pavitt
ATTORNEYS

ROCKET CONTAINING LEAD OXIDIZER SALT-HIGH DENSITY PROPELLANT

This a continuation of application Ser. No. 67,494 filed Aug. 27, 1970, now abandoned.

This invention relates to materials for providing efficient propulsion of vehicles such as rockets and to methods of producing such materials. The invention particularly relates to materials having a high density and stable properties at ambient temperatures and providing considerable energy at elevated temperatures for producing an efficient propulsion of vehicles such as rockets.

For many rocket applications, the amount of propulsion energy capable of being stored in a limited volume is of prime importance. By increasing the amount of energy in each cubic inch of volume, the volume required to store a particular amount of energy can be accordingly reduced. This in turn allows the rocket to be reduced in size and in weight, thereby causing the drag imposed on the rocket during the flight of the rocket through a fluid such as air or water to be correspondingly reduced. Since the drag imposed on the rocket is reduced, the amount of energy required to propel the rocket through a particular distance is reduced so that the amount of propulsion material required becomes correspondingly reduced. This in turn allows a further reduction in the size of the vehicle, with a corresponding reduction in drag. For the above reasons, a rocket required to push a heavy payload or move through a dense or viscous medium may have an increased efficiency if its propulsion material can be stored in a relatively small volume.

The propulsion energy of a meterial is commonly measured in pound-seconds of force per pound of propellant (lb.sec/lb.). For example, if a propellant has a "specific impulse" of 200 lb.sec./lb., it could produce in a rocket motor 200 pounds of thrust (or force), per pound of weight of the propellant, for a duration of 1 second. It could also produce any combination of thrust and time which, when multiplied, equalled 200 lb.sec. per pound of propellant.

Various attempts have been made to increase the efficiency of propellants. For example, attempts have been made to increase the temperature of combustion of the different materials in the propellant. One broad line of effort has been to use in the propellant materials which have a low heat of formation or a low bond energy so that an increased amount of energy is available to be converted into heat. However, in order to have a low heat of formation, the materials generally must have a low margin of stability so that they are more dangerous to process, to store and to use than conventional materials.

Another approach toward increasing the specific impulse of the propulsion material has been to decrease the average molecular weight of the exhaust products. For example, attempts have been made to combust highly energetic materials such as beryllium. However, these metals are quite toxic when vaporized and greatly increase the health hazards of anyone using such metals. Furthermore any use of such metals in a combustible material would tend to add to contaminations in the atmosphere if they should become adopted on a widespread basis.

When materials such as magnesium, beryllium and titanium are used in the propulsion material, the density of the propulsion material tends to be reduced since magnesium, titanium and beryllium are relatively light. This has tended to be disadvantageous since the amount of energy obtained per cubic inch of volume becomes reduced. In other words, even though such metals as beryllium, titanium and magnesium have a high energy, the available energy per cubic inch of the propulsion material has not tended to be increased in view of the decreased density of the material.

When metals such as beryllium have been used in the propulsion material, gases such as hydrogen have been added to the material, generally as a hydride of the metal. These hydrides tend to be somewhat unstable, requiring considerable care and special equipment for safe handling of them.

An extensive list of metallized solid propellants was published in 1966 by Reinhold Publishing Corp. in a book entitled, "Propellant Chemistry". This book was written by Stanley F. Sarner, Senior Research Chemist and Theoretical Analyst of Thiokol Chemical Corporation of Elkton, Maryland. This book lists values of specific impulse and density for approximately twenty formulations of solid propellants which allegedly provide a high energy. The values of specific impulse for these formulations range upwardly to approximately 313.8 lb. sec. per pound of propellant formulation. The values of density are as high as approximately 0.0737 lb/inch$^3$. However, the maximum value of density impulse capable of being provided by any of these formulations is less than approximately 17.9 lb.sec/in$^3$. Furthermore, these formulations involve the use of toxic materials. Actually, practical and operable formulations now available provide maximum values of density impulse of approximately 15 lb.sec/in$^3$. As will be appreciated, values of density-impulse are important since they indicate the amount of energy available for propulsion per cubic inch of propulsion material.

This invention provides propulsion materials which overcome the above disadvantages. The propulsion materials have a high density and provide a high value of specific impulse. They can be safely and easily formulated and are stable at ambient and elevated temperatures. They are not toxic in their formulation, storage or use. Furthermore, density-impulses as high as approximately 24 lb.sec. per pound of formulation are obtained from the propulsion materials constituting this invention.

The propulsion materials of this invention include a binder, a curative for the binder (whenever necessary), an oxidizer and a fuel additive. One of the features of the invention is the use in the propulsion materials of an oxidizer with a relatively high value of specific gravity or density and with stable properties and with properties of supplying relatively high amounts of oxygen per unit of volume to the fuel additives of the reducing agents in the propulsion material. Suitable oxidizers may be selected from a list including potassium iodate ($KIO_3$), lead nitrate ($Pb(NO_3)_2$), potassium perchlorate ($KClO_4$), strontium nitrate ($Sr(NO_3)_2$), barium nitrate ($Ba(NO_3)_2$), cesium nitrate ($Cs(NO_3)$), and rubidium nitrate ($Rb(NO_3)$).

Some of the materials included in this invention are similar to materials included in a "Smoke Producing Propellant" disclosed in U.S. Pat. No. 3,418,184, which issued on Dec. 24, 1968, for use in influencing the weather. However, this invention includes other materials which are different from the materials included in the invention disclosed and claimed in U.S. Pat. No. 3,418,184. Furthermore, the percentages of the materials common to this invention and the invention of U.S. Pat. No. 3,418,184 are quite different, the materials of this invention having a different range than the materials of the invention in U.S. Pat. No. 3,418,184. The results obtained from this invention are also distinctly and unexpectedly different from the operation of the invention in U.S. Pat. No. 3,418,184 in seeding clouds to influence weather.

Figure 1:
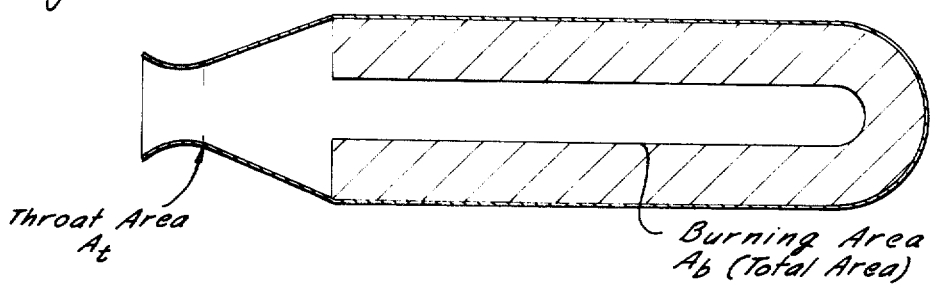
FIG. 1 illustrates the configuration of the test equipment in which the formulations specified in FIG. 1 have been tested.

FIG. 4*a* is a chart illustrating various formulations of propulsion material which have been tested with a polybutadiene binder and further illustrating certain results obtained from such formulations.

FIG. 4*b* is a chart illustrating various formulations of propulsion material which have been tested with a polysulfide binder and further illustrating certain results obtained from such formulation;

FIG. 4*c* is a chart illustrating various formulations of propulsion material which have been tested with a polybutadiene binder and with multiple oxidizers and further illustrating certain results obtained from such formulations;

FIG. 4*d* is a chart illustrating various formulations of propulsion material which have been tested with a polysulfide binder and with multiple oxidizers and further illustrating certain results obtained from such formulations.

The material constituting this invention includes a binder having properties of providing hydrocarbon linkage and of being cured at a particular temperature. The binder may be selected from a group including polysulfides, carboxy-terminated polybutadiene polymers, tetrafluorethylene, polyfluroethylene propylene and acetal homopolymers (which do not cure but remain thermoplastic). These binders are advantageous since they retain good physical properties even in environments at high temperatures. For example, acetal homopolymers designated by the trademark or tradename "Delrin" melt at approximately 354°F and tetrafluorethylenes designated by the trademark or tradename "Teflon" melt at temperatures above 600°F. Certain of these binders such as the polysulfides and the carboxy-terminated polybutadiene polymers are castable and have been cured at ambient temperatures and also at oven temperatures with other materials to form the propellant formulations constituting the invention.

A number of propulsion materials have been formulated successfully with a mixture of a binder such as polybutadiene with carboxy-terminated linkages and a curing agent such as 1, 2, 4 Tris [2-(1-Aziridinyl)Ethyl] Trimellitate. The polybutadiene has been designated as "Butarez CTL Type II". Such a binder constitutes a liquid rubber polybutadiene with carboxy-terminated linkages. It has carboxy end-groups on both ends of the polymer chain, as illustrated as follows:

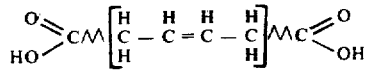

The binder has a relatively narrow molecular weight distribution and is not easily crystallized. This allows the cured composition of the polymer to remain rubbery to very low temperatures.

As seen in FIG. 4, the percentage of the binder in the propulsion formulation has varied between approximately 8% and 27%. Furthermore, as seen in FIGS. 4*a* and 4*c* the percentage of the polybutadiene in the propulsion formulation has varied between approximately 6% and 13% and the percentage of triacetin in the formulation has varied between approximately 1% and 4%. The percentage of 1, 2, 4, Tris [2-(1-Aziridinyl] Trimellitate has generally been less than one percent (1%) in the formulation. Furthermore, as shown in FIGS. 4*b* and 4*d*, the percentage of polysulfide has varied from approximately 9% to approximately 27%.

Different types of oxidizers may be used in the propulsion materials constituting this invention and mixtures of these various types of oxidizers may also be used. Tests have primarily been performed on lead nitrate, lead peroxide and potassium perchlorate as the oxidizer. In these tests, as indicated in FIG. 4*c*, the percentage of the oxidizer has varied between approximately 60% and 75%. In these tests, the amount of potassium perchlorate has varied between 0% and approximately 20% by weight of the propulsion formulation and the amount of lead dioxide has varied between 0% and 2% by weight of the formulation, as may be seen from the charts constituting FIG. 4. The remainder of the Oxidizer in each of these tests has generally been lead nitrate.

In addition to the tests discussed above and indicated in FIGS. 4*a* and 4*c*, the feasibility of using other oxidizers has been indicated. For example, the feasibility of providing propulsion formulations with oxidizing agents as high as approximately 85% of the weight of the formulations has been indicated. These feasibility studies have involved the use of potassium iodate alone or in combination with lead nitrate, and the use of lead iodate ($Pb(IO_3)_2$) alone or in combination with lead dioxide ($PbO_2$). Some of these formulations are listed in FIG. 4c with their indicated values of density impulse. Other oxidizers such as strontium nitrate, barium nitrate, cesium nitrate, rubidium nitrate, ammonium perchlorate potassium permanganate, potassium chlorate, potassium periodate, potassium nitrate, urea nitrate and guanidine nitrate can also be used as secondary oxidizers to alter the ballistic and physical properties as desired.

The oxidizers described above have certain important advantages. For example, they are dense and have high concentrations of oxygen per unit of volume and they are stable even at relatively high temperatures. They further have a relatively low heat of formation so that a substantial portion of the heat liberated by the oxidizers during their use in the propulsion formulations is available for use in providing propulsion. Specifically, lead nitrate has approximately 0.041 moles of oxygen per cubic centimeter. It has a specific gravity of approximately 4.53 grams per cubic centimeter. It has a decomposition temperature of approximately 470°C and has a heat of formation of only approximately 107.35 kilocalories per mole of oxygen. It can be reacted to produce reasonably good enthalpy. Furthermore, lead can be vaporized at a temperature of approximately 1750°C so that it can flow through the rocket nozzle in the gaseous phase.

The decomposition temperatures of the oxidizers are sufficiently higher than the melt temperatures of the binder to permit processing as a propellant mixture with reasonable safety. For example, lead nitrate decomposes at approximately 878°F, strontium nitrate at approximately 1058°F and barium nitrate at approximately 1097°F. WIth this relationship of temperatures in comparison to the melting temperatures of the binders, it is feasible to extrude, mold by injection or press the propellants with conventional plastic processing machinery.

The fuel additive has primarily been aluminum, which becomes oxidized to aluminum oxide by the oxidizer. This fuel additive has ranged in weight from approximately 8% to approximately 30% of the propulsion formulation. Although such metal is commonly added as a powder, it could be added as filaments of fine wire or as sheets of thin foil. When used as filaments or sheets, the aluminum provides substantial physical reinforcement to the propellant. In these forms, the aluminum could provide composites or laminates of high strength. This is desirable since considerable forces must be withstood by a propellant in various applications such as antimissile rocket applications.

Other metals than aluminum are also theoretically useful as the fuel additive in some propulsion formulations. These include beryllium, magnesium, lithium and titanium. All of these metals are advantageous since they have high melting temperatures. For example, aluminum has a melting temperature of approximately 1220°F and strontium has a melting temperature of approximately 1202°F. In this way, the propulsion materials can be formulated with reasonable safety when these additives are included.

Various additives have been used to control the rate of propellant burning or to change the sensitivity of the burning rate to pressure. These additives have included copper manganite, cupric oxide and iron oxide, and a liquid iron containing burning rate catalyst designated by the trademark or tradename "HYCAT 6". The amount of additive used has varied between 0% and 5% by weight of the propulsion formulation, but in certain formulations the amount of additive has been as high as approximately 15%, as may be seen from the chart constituting FIG. 4*a*. Other additives tested have included chromium oxide, manganese dioxide, cuprous oxide, n-butyl ferrocene, cupric acetylacetonate, molybdenyl-bis-acetylacetonate, titanium acetylacetonate, calcium oxalate, and lead oxalate.

The propulsion formulations have several advantages in addition to those described above. Although the values of specific impulse for the propellants using the oxidizers constituting this invention range from 190 lb.sec./lb. to 260 lb.sec./lb. and accordingly are within the range of previous propellants, the high density of the propellants using these oxidizers produces theoretical values of density-impulse from approximately 22 lb.sec./in.$^3$ to 27.6 lb.sec./in.$^3$. Comparing these values with current practical values of approximately 15 lb.sec/in.$^3$ for the density-impulse of conventional propellants now in use, an increase of 60% can be easily realized over these conventional propellants.

Figure 2:
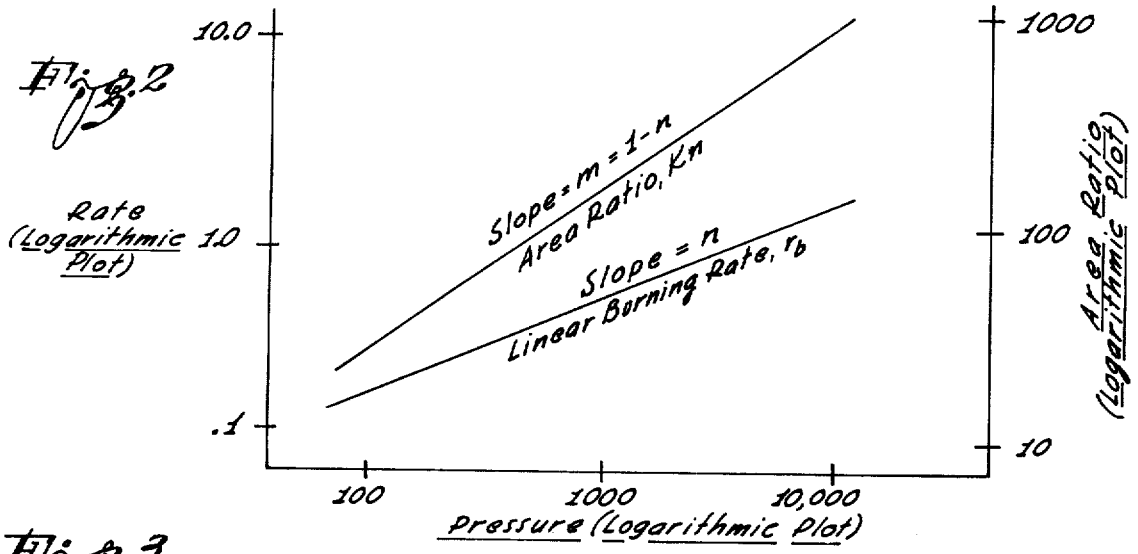
FIG. 2 constitutes curves showing the relationship between the pressure of the exhaust gases from the burning propellant and the rate at which the propellant burns.

FIG. 1 illustrates a chamber in which the propellants constituting this invention have been combusted. As will be appreciated, the gases combust in the burning area and escape through the throat area. FIG. 2 illustrates the relationship between the pressure of the gas escaping from the burning area into the throat area and the rate at which the propellant is combusted in the burning area.

Figure 3:
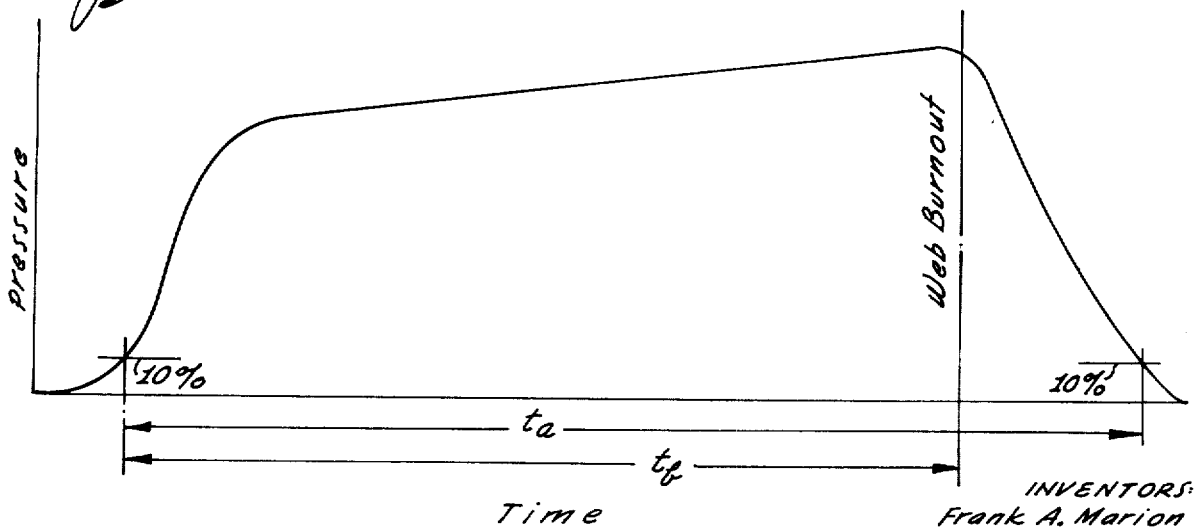
FIG. 3 is a curve illustrating the relationship between time and pressure of the exhaust gases from the burning propellant.

FIG. 3 illustrates the pressure of the gases at progressive instants of time in the chamber illustrated in FIG. 1. As will be appreciated, the term $t_a$ represents the time between an initial pressure of 10% of maximum pressure during pressure build-up and 10% of maximum pressure during the period of pressure reduction.

FIGS. 4*a* – 4*d* are charts illustrating various compositions of the propellants constituting this invention. FIG. 4*a* illustrates various formulations of propellants which have been tested with polybutadiene as a binder and with lead nitrate as the oxidizer. FIG. 4*c* illustrates various formulations of propellants which have been tested with polybutadiene as a binder and with a mixture of lead nitrate and other materials such as potassium perchlorate, ammonium perchlorate and lead dioxide as the oxidizers. FIG. 4*b* illustrates various formulations of propellant which have been tested with polysulfides as the binder and with lead nitrate essentially as the oxidizer. FIG. 4*d* illustrates various types of propellants which have been tested with polysulfides as the binder and with a mixture of lead nitrate and ammonium perchlorate as the oxidizer.

FIGS. 4*a* to 4*d*, inclusive, illustrates the values of important parameters for such different materials. These parameters include the burning rates ($r_b$) of the propellants at a pressure of one thousand (1,000) pounds per square inch, the slope ($n$) of the burning rate curves as shown in FIG. 2 at the pressure of one thousand (1,000) pounds per square inch, the ratio ($K_n$) of the burning area to the throat area in the structure shown in FIG. 1, specific impulse, density, and density-impulse.

As will be appreciated, multiple rocket motors of each individual propellant were tested to confirm the results of the previous tests on these formulations. In the charts constituting FIG. 4*a* – 4*d*:

C* = characteristic exhaust velocity in feet/second. This value indicates how fast the exhaust gas is being passed out of the burning chamber. The value is derived from the pressure-time curve of FIG. 3.

Furthermore, $\overline{p}_b$ = average pressure of the exhaust gas over the time $t_b$ $$I = \text{total impulse delivered} = \int_{10\%}^{10\%}$$

$$Fdt = \int Fdt \text{ over the time period } t_a$$

$$I_{sp} = \frac{I}{W_p} = \frac{\text{lb-sec impulse}}{\text{mass of propellant in pounds}}$$

Although this application has been disclosed and illustrated with reference to particular applications, the principles involved are susceptible of numerous other applications which will be apparent to persons skilled in the art. The invention is, therefore, to be limited only as indicated by the scope of the appended claims.

We claim:

1. In combination for producing propulsion, a closed combustion chamber having a hollow configuration and including a restricted throat opening to the atmosphere to provide for the passage of combustion gases from the combustion chamber to the atmosphere through the restricted throat, a propulsion-producing material disposed in the combustion chamber and having properties of being combusted to produce combustion gases in the absence of atmospheric oxygen in the member and of passing the combustion gases into the atmosphere through the restricted throat in the combustion chamber to produce propulsion of the combustion chamber, the propulsion-producing material including:

a binder providing hydrocarbon linkages, a lead compound oxidizer formed from inorganic lead oxidizer salts and having dense characteristics and stable properties at ambient temperatures and through a particular temperature range above ambient, and a particulate metal fuel additive having properties of being oxidized by the oxidizer, the binder having a range of percentages by weight between eight percent (8%) and seventeen percent (17%) and the particulate metal fuel additive having a range of percentages by weight between eight percent (8%) and thirty percent (30%) and the remainder constituting the oxidizer.

2. The combination set forth in claim 1, wherein the binder is selected from a group consisting of polysulfides, carboxy-terminated polybutadiene polymers, polytetrafluoroethylene, polyfluoroethylene-propylene copolymers and acetal homopolymers.

3. The combination set forth in claim 1 wherein the oxidizer is selected from a group consisting of the nitrate and iodate of lead.

4. The propulsion material set forth in claim 3, wherein the particulate metal fuel additive is selected from a group consisting of aluminum, beryllium, magnesium and titanium.

5. In combination for producing propulsion, a closed combustion chamber including a restricted throat opening to the atmosphere, the to provide for the passage of combustion gases through the restricted throat into the atmosphere, and a propulsion-producing material having properties of being combusted to produce combustion gases for escape of the combustion gases through the restricted throat in the combustion chamber to provide propulsion of the combustion chamber, the propulsion-producing material including:

a binder providing hydrocarbon linkages to become oxidized, the binder being selected from a group consisting of polysulfides and carboxy-terminated polybutadiene polymers, polytetrafluoroethylene, fluoroethylene-propylene copolymers and acetal homopolymers, an oxidizer formed from an inorganic lead oxidizer salt and having dense characteristics and stable properties at ambient temperatures and through a particular temperature range above ambient and having a low heat for formation, and a particulate metal fuel additive having properties of being oxidized by the oxidizer, the particulate metal fuel additive being selected from a group consisting of aluminum, beryllium, magnesium and titanium.

6. The combination set forth in claim 1 wherein the binder has a range of percentages by weight between eight percent (8%) and seventeen percent (17%) and the particulate metal fuel additive has a range of percentages by weight between eight percent (8%) and thirty percent (30%) and the remainder constitutes the inorganic lead oxidizer salt.

7. The combination set forth in claim 5 wherein further additives are included to control the rate at which the propulsion material burns, the additives being selected from a group consisting of copper manganite, cupric oxide, manganese dioxide, cuprous oxide, n-butyl ferrocene, cupric acetylacetonate, molybdenyl-bis-acetylacetonate, titanium acetylacetonate, calcium oxalate and lead oxalate.

8. The combination set forth in claim 7 wherein the further additives constitute between approximately zero percentage (0%) and five percent (5%) by weight.

9. In combination for producing propulsion, a closed combustion chamber including a restricted throat, the combustion chamber being constructed to provide for the passage of combustion gases from the combustion chamber into the atmosphere through the restricted throat, and a propulsion-producing material having properties of being combusted to produce combustion gases for escape of the combustion gases through the restricted opening in the combustion chamber to provide propulsion of the combustion chamber, the propulsion-producing material including:

a binder providing hydrocarbon linkages and capable of being cured at a first particular temperature, the binder including a curative for providing a curing of the binder, an oxidizer formed from an inorganic lead oxidizer salt and having dense characteristics and stable properties at ambient temperatures and through a particular range of temperatures greater than the first particular temperature and having a low heat of formation and a relatively great amount of oxygen to provide an oxidizing action, a particulate metal fuel additive having properties of being oxidized by the inorganic lead oxidizer salt, and an additive having properties of controlling the rate at which propulsion-producing material is combusted.

10. The combination set forth in claim 9 wherein the binder is selected from a group consisting of polysulfides and carboxy-terminated polybutadiene polymers.

11. The combination set forth in claim 10 wherein the inorganic lead oxidizer salt is selected from the group consisting of the nitrate and iodate of lead.

12. The combination set forth in claim 11 wherein the fuel additive is selected from a group consisting of aluminum, beryllium, magnesium and titanium.

13. The combination set forth in claim 12 wherein the additives to control the rate of burning are selected from a group consisting of copper manganite, cupric oxide, iron oxide, chromium oxide, manganese dioxide, cuprous oxide, n-butyl ferrorene, cupric acetylacetonate, molybdenyl-bis-acetylacetonate, titanium acetylacetonate, calcium oxalate and lead oxalate.

14. The combination set forth in claim 13 wherein the binder had a range of percentages by weight between eight percent (8%) and seventeen percent (17%) and the particulate metal fuel additive has a range of percentages by weight between eight percent (8%) and thirty percent (30%) and the additive to control rate of burning has a percentage by weight up to five percent (5%) by weight and the remainder constitutes the inorganic lead oxidizer salt.

* * * * *